United States Patent [19]

Kahn

[11] 3,939,640

[45] Feb. 24, 1976

[54] SYSTEM FOR ILLUMINATING THE DISPLAY OF A WRIST WATCH

[76] Inventor: Leonard R. Kahn, 70 N. Grove St., Freeport, L.I., N.Y. 11520

[22] Filed: Dec. 12, 1974

[21] Appl. No.: 532,065

[52] U.S. Cl. ..... 58/23 R; 58/50 R

[51] Int. Cl.[2] ..... G04C 3/00

[58] Field of Search ..... 58/50 R, 23 R, 23 BA; 200/DIG. 2, 62, 52; 240/6, 43

[56] References Cited

UNITED STATES PATENTS

| | | | |
|---|---|---|---|
| 3,161,737 | 12/1964 | Hall | 200/61.52 |
| 3,729,923 | 5/1973 | Brigliano et al. | 58/50 R |
| 3,742,699 | 7/1973 | Bergey | 58/50 R |
| 3,810,356 | 5/1974 | Fujita | 58/85.5 |
| 3,841,080 | 10/1974 | O'Donald | 58/23 BA |
| 3,855,784 | 12/1974 | Foellner | 58/50 R |

FOREIGN PATENTS OR APPLICATIONS

| | | | |
|---|---|---|---|
| 120,324 | 9/1945 | Australia | 200/61.52 |
| 648,661 | 12/1928 | France | 200/61.52 |

*Primary Examiner*—Ulysses Weldon

[57] ABSTRACT

A system for illuminating the display of a wrist watch by motion of the wrist. The watch incorporates means for sensing a specific motion of the watch and the sensing means is connected to means to cause the digital display to become active (illuminated).

Storage means is provided for illuminating the display for a 5 second interval so that the user may conveniently read the display. Additional circuitry for displaying the day and month is described.

10 Claims, 2 Drawing Figures

SYSTEM FOR ILLUMINATING THE DISPLAY OF A WRIST WATCH

BACKGROUND OF THE INVENTION

While the invention is subject to a wide range of applications, it is especially suited for use with wrist watches and will be particularly described in that connection.

There is increasing interest in the use of digital displays in wrist watches. One popular type of display is composed of light emitting diodes (LED). Such displays are attractive, reliable, and easily read; however, they require appreciable energy for operation. Because the power supply for a wrist watch is quite small, such displays are generally activated by a push button switch. When one is carrying packages or driving a car, the requirement to operate the push button is quite inconvenient and is a definite drawback to the use of such watches.

The use of the position of the human body to energize an electrical circuit has been disclosed in my prior U.S. Pat. No. 3,683,130. In that invention, the position of the head is used to activate a head set which allows one to hear sounds while being protected from high ambient noise. The circuitry in U.S. Pat. 3,683,130 is activated by head position and the system does not rely upon the speed or acceleration of the motion.

SUMMARY OF THE INVENTION

A general object of the present invention is to achieve long battery life in a digital watch without the operation of a push button switch.

A further object is to allow the sequential reading of the time and the day and the month without operation of a push button switch.

Presented is a system for illuminating a display of a wrist watch. This system incorporates means for sensing a predetermined motion of the watch and means for activating (illuminating) the display responsive to the sensing means. The predetermined motion may be a rapid rotation of the wrist. The sensing means is used to control means for activating the display when the predetermined or specified motion is sensed.

A storage means is provided so that the display stays in the active (illuminated) condition for a long enough period of time for one to read the display. Circuitry is described which displays the month and day when the user repeats the specified motion of the watch.

For a better understanding of the present invention, together with other and further objects thereof, reference is had to the following description, taken in connection with the accompanying drawings, while its scope will be pointed out in the appended claims.

DESCRIPTION OF THE PREFERRED EMBODIMENTS

Figure 1:
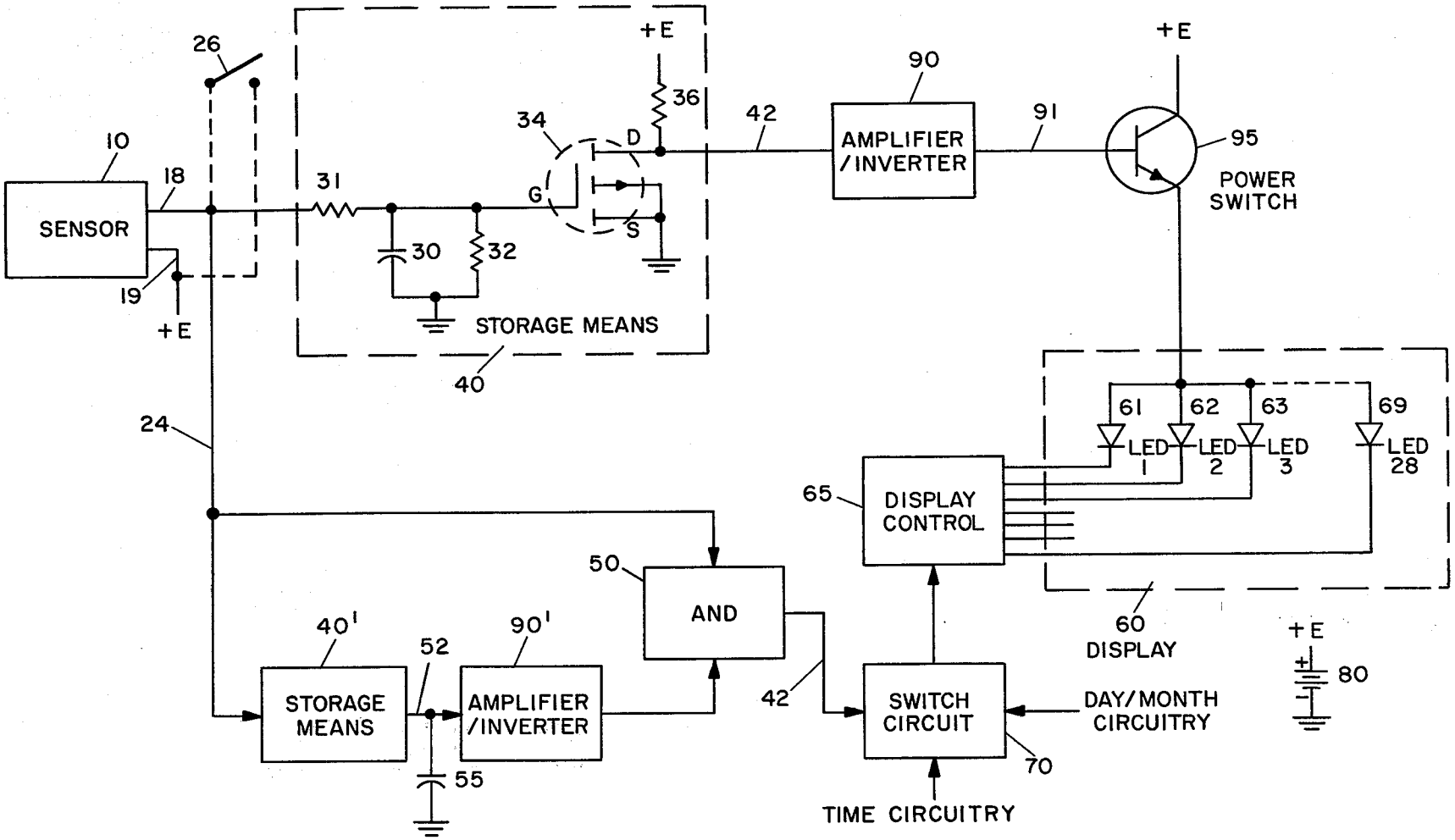
FIG. 1 shows, in block and schematic form, the system as applied to a digital watch to be illuminated by wrist action.

FIG. 1 shows the main elements of the system for illuminating the display of a wrist watch.

When sensor 10 is activated by the predetermined motion, connection 18 is momentarily connected to connection 19 and thus the +E volts charges capacitor 30 through resistor 31. The charging of capacitor 30, through resistor 31, takes less than approximately 10 milliseconds. Resistor 31 in addition to setting the charging time also protects sensor 10 from excess charging current and isolates line 24 from capacitor 30.

The voltage across capacitor 30 is used to control field effect transistor 34. This transistor is a P channel enhancement mode device. Such a device will only pass appreciable current if its gate is positive relative to its source by at least a threshold voltage amount. Thus, when capacitor 30 is charged to the threshold voltage, transistor 34 switches "on" causing a voltage drop across resistor 36 and reducing the voltage at the drain of the transistor 34.

Due to the action of the amplifier/inverter 90, this low voltage will produce a relatively high positive voltage condition on line 91. The positive voltage will cause transistor 95 to conduct passing current through certain light emitting diodes, LEDs, in display 60. Just which diodes pass current and radiate light at a given instant is controlled by the Display Control Circuit 65.

Since it is common practice to use a maximum of seven LED units to represent a number and the time is displayed by four digits in display 60, a minimum of 28 diodes would be used in the display.

The display would, in the preferred embodiment, remain illuminated for a period of approximately 5 seconds after the user commanded its operation by causing a predetermined wrist motion. When sensor 10 returns to its normal condition after sensing the predetermined motion, the circuit between connections 18 and 19 is opened and capacitor 30 discharges through resistor 32. The values of components 30 and 32 are such that in approximately 5 seconds the voltage will be reduced to below the threshold voltage required to produce appreciable drain current and the voltage at the drain will return to a more positive value. This voltage will then produce a low voltage at the output of amplifier/inverter 90 and therefore transistor power switch 95 will be controlled to the "off" condition. Accordingly, the LEDs in display 60 will not receive current, extinguishing the display and minimizing the power drained from power source 80.

This invention may also be used to allow wrist motion activation of the display of date information. In order to read the day and month it is necessary for the user to repeat the predetermined motion within approximately 30 seconds of the initial motion. Approximately 10 milliseconds after the initial motion is sensed, the storage capacitor feeding transistor 34 in storage means 40' is charged. Storage circuit 40' utilizes the same circuit as storage circuit 40 with the exception that the value of resistor 32 is increased by a factor of 6 times and accordingly a storage of approximately 30 seconds is achieved.

The output of storage circuit 40' is inverted by Amplifier/Inverter 90' causing a positive voltage to be fed to AND gate 50 when the storage circuit is active. If a second predetermined motion is sensed by sensor 10 within 30 seconds after the first predetermined motion both inputs to the AND gate will be positive and the AND gate will be switched on. The AND gate 50, connected to switch circuit 70, then causes the display control 65 to be switched to the Day/Month circuitry instead of the Time circuitry. If the second predetermined motion is not sensed within 30 seconds switch 70 will remain in its rest condition passing time information to 65.

It is important that the date information is not switch to the display control during the initial period that the predetermined wrist motion is sensed. To insure that such premature switching does not occur, capacitor 55 is connected to ground and line 52. The value of capacitor 55 should be large enough to insure that the enabling voltage from Amplifier/Inverter 90' to the AND gate is delayed until sensor 10 returns to its rest open circuit condition. This procedure insures that the time not the date information is displayed upon the sensing of the initial predetermined wrist motion. The second motion, when sensed by sensor 10, also causes storage means 40 to operate causing Power Switch 95 to illuminate the Display in the same manner as described above.

If only the display of time is required, then circuits 40', 90', 50, 55, 70 and the Day/Month circuitry may be deleted.

If desired, a push button switch 26 may be provided in addition to the wrist motion activation circuit. The connection of the push button switch 26 is shown dotted to connections 18 and 19 of sensor 10.

Figure 2:
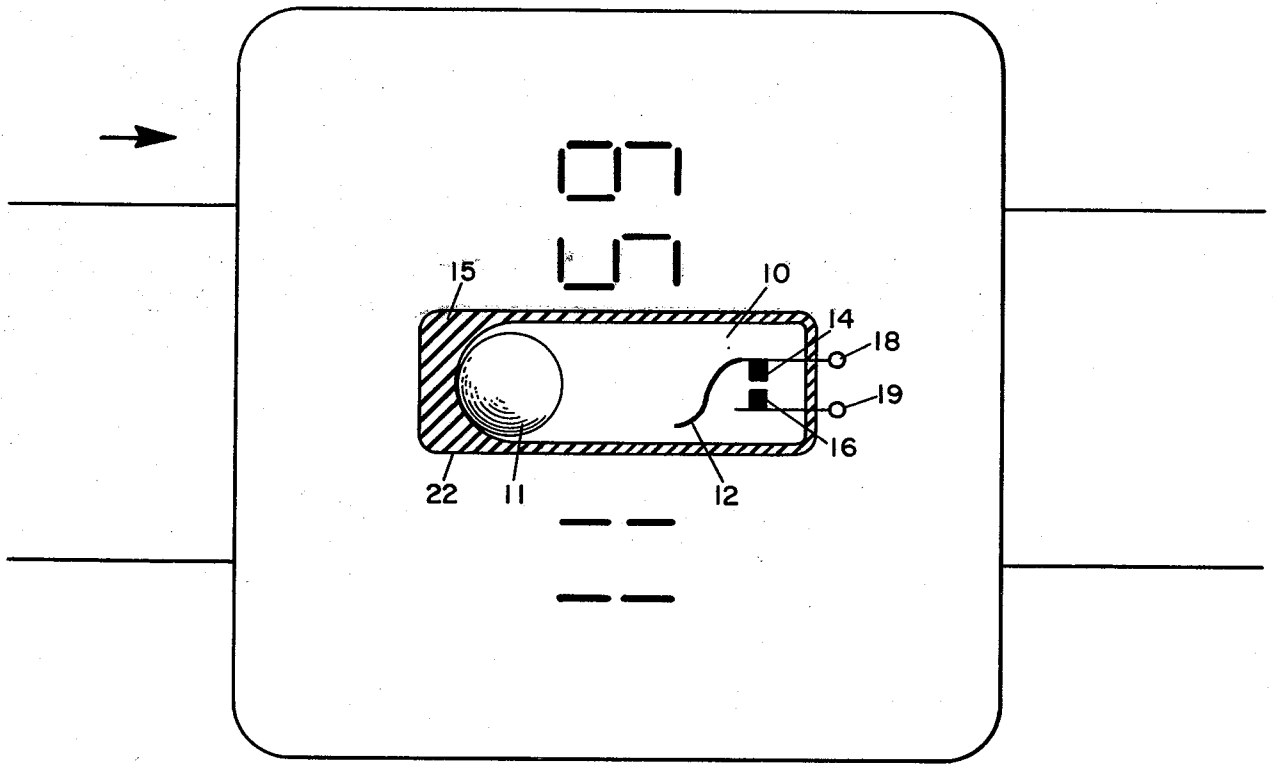
FIG. 2 shows a drawing of an outline of a watch incorporating an impact switch suitable for providing a momentary switch closure.

FIG. 2 is a drawing of an impact switch mounted in a watch. This is one device suitable for sensing the quick rotating motion of the wrist. FIG. 2 also shows the display activated and indicating the time to be 11 59.

The sensor is mounted in the case of the watch so that the sensor is most sensitive to the predetermined motion. An arrow located at the upper left hand corner of FIG. 2 shows the direction of the preferred predetermined motion for activating the display. It should be noted that this same motion is normally used to place a watch in position for reading its display.

A weighted ball, 11, is mounted within the confines of the container, 22, and is free to roll. The wall of container 22 is lined with a liner, 15, which is made of soft material to dampen bounce and noise. When the watch is subjected to the predetermined motion the ball, 11, strikes spring member, 12. This causes member, 12, to deflect bringing electrical contact, 14, down and closer to electrical contact 16. If the wrist motion produces sufficient momentum of the ball, 11, the impact of the ball with member 12 will cause a deflection of 12 sufficient to cause a momentary contact between switch contacts 14 and 16 producing a closed electrical circuit between switch outputs 18 and 19.

Normal motions of the wrist should not deflect member 12 sufficiently to cause contact closures. An adjustment may be provided to vary the distance between electrical contacts 14 and 16 to accommodate individual users. A person who is quite active would require wider contact spacing to avoid false activation of the display than one whose wrist movements are less rigorous. It should be noted that the sensor 10 could directly supply power of display 60 and if the display devices had a sufficiently long decay characteristic the requirement for storage device 40 and circuits 90 and 95 would thus be eliminated.

Of course, some users may desire push button operation as well as the wrist action system and this may be readily provided. The push button switch contacts would be connected to contacts 18 and 19 of sensor 10 as shown dotted on FIG. 1.

While there has been described what is at present considered to be the preferred embodiment of the invention, it will be obvious to those skilled in the art that various changes and modifications may be made therein, without departing from the invention, and it is, therefore, aimed in the appended claims to cover all such changes and modifications as fall within the true spirit and scope of the invention.

What is claimed is:

1. A watch display system comprising;

a specific motion sensor, a first storage means activated by the motion sensor for maintaining illumination of the display for a sufficient reading period after each perception of said motion, means for connecting an electrical energy source to the display where said connecting means is controlled by the first storagge means, a second storage means having an appreciably longer storage period than the first storage means and which second storage means is also activated by the motion sensor, AND gate means for sensing repeated specified motion within a specified period of time, and means for switching the display system from time of day information circuitry to day/month circuitry when the AND circuitry output indicates the occurrence of the repeated specified motion within said longer storage period of time.

2. A watch display circuit according to claim 1 wherein said specific motion is a twist of the wrist.

3. A watch display circuit according to claim 1 wherein the appreciable longer storage period is approximately thirty seconds.

4. A system for illuminating the display of a wrist watch which displays the time of day and the date information comprising;

means for sensing a predetermined motion of the watch, means activated by the motion sensing means for illuminating the display to display time of day information, means for timing the period between the occurrence of the first predetermined motion and a repeated predetermined motion of said sensing means, means responsive to timing means for connecting the date information to the display only if the repeated predetermined motion occurs within a particular period following a first predetermined motion of the watch, and said activated means illuminating the display when the date information is connected to said display.

5. A watch display illuminating system according to claim 4, wherein said particular time period is approximately 30 seconds.

6. A wrist watch control system for displaying the time of day and the month/day at different instances comprising;

an inertia type switch for sensing the predetermined motion of the wrist, means including a first storage circuit activated by the inertia activated switch to cause illumination of a display for a period sufficient to read the time information conveniently, a second storage circuit having a second period appreciably longer than the first storage circuit and activated by the inertia switch, AND means for sensing the reactivation of the inertia switch during a period when the second storage means is still in an active state, means for switching the display circuitry from the time of day display system to the day/month system when said switching means is activated by an AND circuitry.

7. The watch control circuitry of claim 6 wherein display period is approximately 5 seconds and the second period is approximately 30 seconds.

8. A system for illuminating the display of a wrist watch incorporating means for sensing a predetermined motion of the watch, said sensing means comprising an electrical contact which closes when the predetermined motion is sensed and connects voltage to a storage capacitor, the storage capacitor in turn is connected to a gate of a field effect transistor which, when fed sufficient gate voltage, passes current to the display causing the display to illuminate.

9. A watch display illumination system according to claim 8 where the storage capacitor is discharged through a resistor having a value so as to discharge the capacitor to a point where the field effect transistor ceases to conduct appreciable electrical current after a sufficient period of time for one to conveniently read the watch display.

10. A watch display circuit as claimed in claim 8 wherein a resistor is connected in series with the electrical contacts of the motion sensor so as to eliminate burning of the electrical contact and to isolate the sensor from said storage capacitor.

* * * * *